US005330317A

United States Patent [19]

Akimoto et al.

[11] Patent Number: 5,330,317

[45] Date of Patent: Jul. 19, 1994

[54] TRANSFER DEVICE FOR TRANSFERRING FOLDABLE CONTAINER

[75] Inventors: Koichi Akimoto, Tokyo; Junichi Yamamoto, Otsu, both of Japan

[73] Assignees: Fujimori Kogyo Co., Ltd., Tokyo; Kimura Machinery Industrial Co., Ltd., Shiga, both of Japan

[21] Appl. No.: 963,802

[22] Filed: Oct. 20, 1992

[30] Foreign Application Priority Data

Oct. 24, 1991 [JP] Japan ..... 3-305385

[51] Int. Cl.[5] ..... B65G 56/06

[52] U.S. Cl. ..... 414/797.8; 414/795.6; 414/796.4

[58] Field of Search ..... 414/795.4, 795.6, 796.4, 414/797.4, 797.8, 798, 798.1; 294/115

[56] References Cited

U.S. PATENT DOCUMENTS 2,097,130 10/1937 Miller ..... 294/115
2,958,556 11/1960 Samuelson et al. ..... 294/115
3,790,205 2/1974 Wenz ..... 294/115
3,999,915 12/1976 Stepenske ..... 414/797.8
4,518,301 5/1985 Greenwell ..... 414/797.8
4,919,587 4/1990 Tashiro et al. ..... 414/795.6
5,054,761 10/1991 Dietrich et al. ..... 414/797.8

FOREIGN PATENT DOCUMENTS 948405 2/1964 United Kingdom .

*Primary Examiner*—Michael S. Huppert
*Assistant Examiner*—Gregory A. Morse
*Attorney, Agent, or Firm*—Thompson, Hine and Flory

[57] ABSTRACT

A transfer device for a foldable container which has an approximately cubical shape when unfolded and is provided with a pour spout at one surface is described; a plurality of such containers, which have been folded into an approximately triangular shape by inverting one half of the container within the other half of the container, are extracted one at a time and transferred to the next processing step.

4 Claims, 11 Drawing Sheets

TRANSFER DEVICE FOR TRANSFERRING FOLDABLE CONTAINER

BACKGROUND OF THE INVENTION

1. Field of the Invention

The present invention relates to a device for extracting one at a time approximately cubically shaped containers, formed of a thin film material such as polyethylene and used to hold food or chemical products which are in a liquid state, from a plurality of triangularly folded stacked containers and transferring the extracted container to the next processing step (for example, to the filling position for receipt of the liquid material to be contained).

2. Background Art

A cubically shaped container 1, such as that shown in FIG. 11, formed from a thin flexible film material such as polyethylene, is widely used as a container convenient for use in the transportation of liquid materials such as soy sauce or mirin (Japanese rice wine) or of industrial chemicals. A pour spout 3 is formed below the edge of one surface of container 1, and is closed by twist-on cap 2. Container 1 is filled via pour spout 3 with the liquid to be contained. As is shown in FIG. 13, pour spout 3 has a flange 4*a* and comprises a thread ring 4 into the outer surface of which a screw thread 4*b*, onto which cap 2 is screwed, has been cut. When container 1 is empty, thread ring 4 is retracted back in a position within container 1 thereby allowing container 1 to present a flat outer surface which facilitates even stacking.

Prior to filling container 1 with a liquid material, that is to say in the case where transporting and depositing several empty containers, one half of the container is folded within the other half of the container by being inverted along the diagonal plane which extends between a pair of diagonally opposing edges and passes through the center of the container, as is shown in FIG. 12. By thus folding the containers, the empty space therein is almost completely compressed and the containers 1, when stacked and viewed from the side, have a triangular shape. As shown in FIG. 14, a stacked configuration 1A of containers 1 is formed by stacking several thus folded containers on top of one another.

However, in extracting one at a time containers 1 from the stacked configuration 1A of containers 1 and filling with the material to be contained, it sometimes occurs that the rigidity of the container 1 itself is low therefore making handling difficult. It was therefore not possible to eliminate reliance on manual labor, this creating a serious impedance to automation. Moreover, where filling container 1 with a liquid product for consumption, in consideration of the strict hygienic standards demanded in this case, it was highly desirable to eliminate the reliance on human labor by automating the process wherein containers 1 are extracted one at a time from stacked configuration 1A of containers 1 and transferred to the next processing step.

SUMMARY OF THE INVENTION

The present invention was conceived in consideration of the problems encountered by the background art and has as its object the provision of a device capable of extracting a foldable container from a stack of several of the same and conveying this container on to the next processing step.

The present invention is a transfer device for a foldable container wherein the container is one which is formed from a thin flexible film material, has an approximately cubical shape when unfolded and which is provided with a pour spout at one surface. In the present invention a plurality of such containers, which have been folded into an approximately triangular shape by inverting one half of the container within the other half of the container by folding along the diagonal plane which extends between a pair of diagonally opposing edges and passes through the center of the container, are extracted one at a time and are transferred to the position at which filling with the liquid material to be contained is carried out.

In the transfer device of the present invention, a stacked configuration of containers are maintained such that, for each container, the apex of the container is directed upward and the square lower peripheral edge of the container is approximately horizontal. Further, the transfer device of the present invention is provided with a storage box, at least the bottom surface of which is open. This storage box supports the stacked configuration of foldable containers from the bottom, and is provided with a shutter mechanism with which it is possible to extract the extreme bottom foldable container is provided.

The transfer device according to the present invention is further provided with a container extraction mechanism which is disposed below the storage box and is provided with a head part by means of the vertical action of which, the extreme lowest container is extracted one by one from the stacked configuration of containers. This container extraction mechanism inclines the extracted foldable container so that the pour spout is directed approximately upward and, supporting the container in this orientation, the head part is transported in the direction of inclination of the container.

The transfer device according to the present invention is still further provided with a transfer mechanism which is disposed above the container extraction mechanism, and in which the pour spout of the container which is supported by the head part is gripped by a chuck and is transferred to the next processing step.

In the foldable container transfer device according to the present invention, the operation for extracting containers one at a time from a stacked configuration comprising several or more folded containers and transferring the extracted container to the next processing step, for example a filling step where the containers are filled with the liquid to be stored, does not relay on human labor and is an almost entirely automated operation. Furthermore, with the transfer device of the present invention, even in the case where handling is rendered difficult because the low rigidity of a flexible container, it is possible to carry out the transfer of the container with accuracy and ease.

A BRIEF DESCRIPTION OF THE DRAWINGS

DETAILED DESCRIPTION OF THE PREFERRED EMBODIMENTS

An explanation of the first embodiment of the present invention follows below with reference being given to the Figures.

Figure 1:
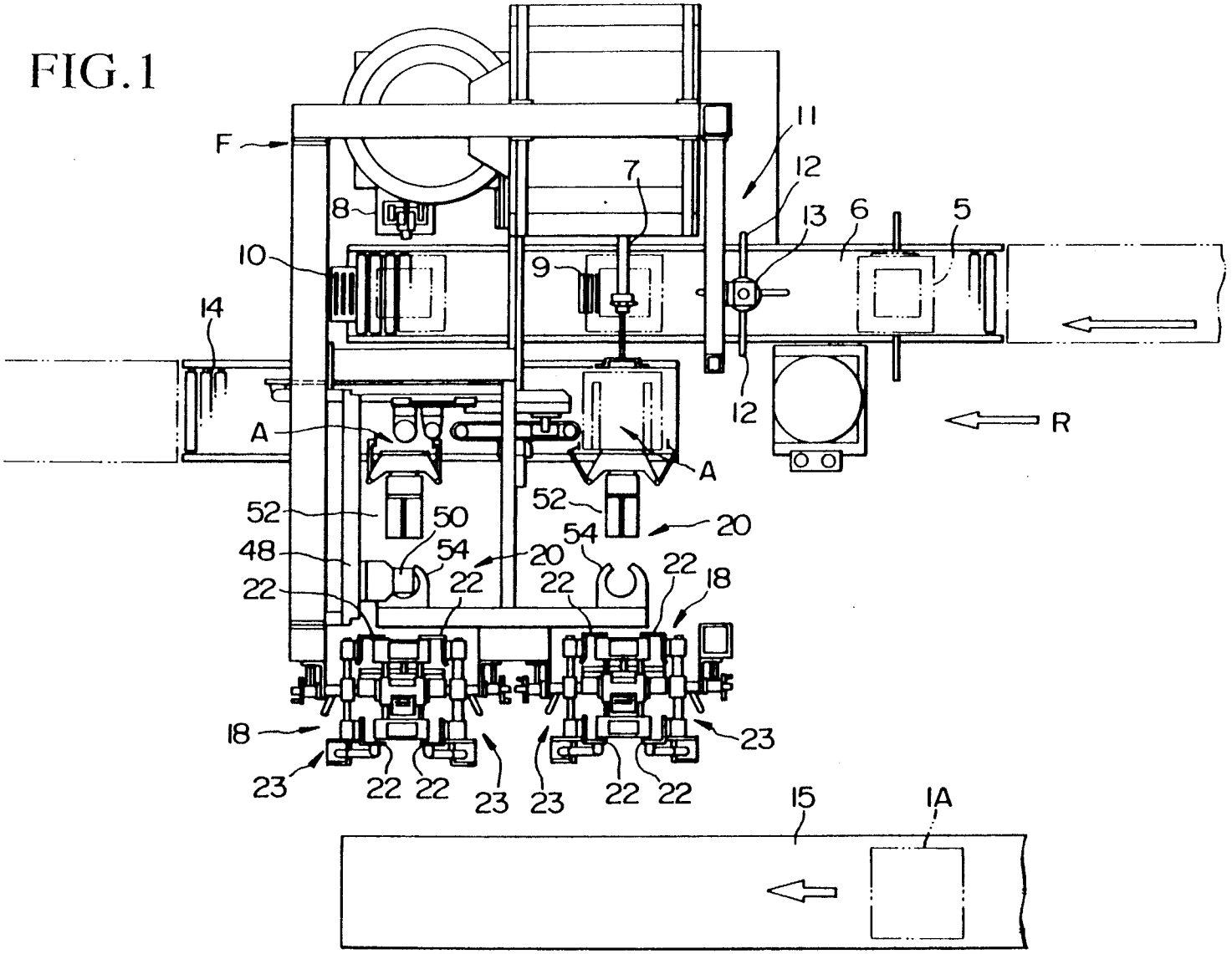
FIG. 1 is an overall plan view of an automatic filling apparatus into which two of the devices according to the present invention have been incorporated.
Figure 2:
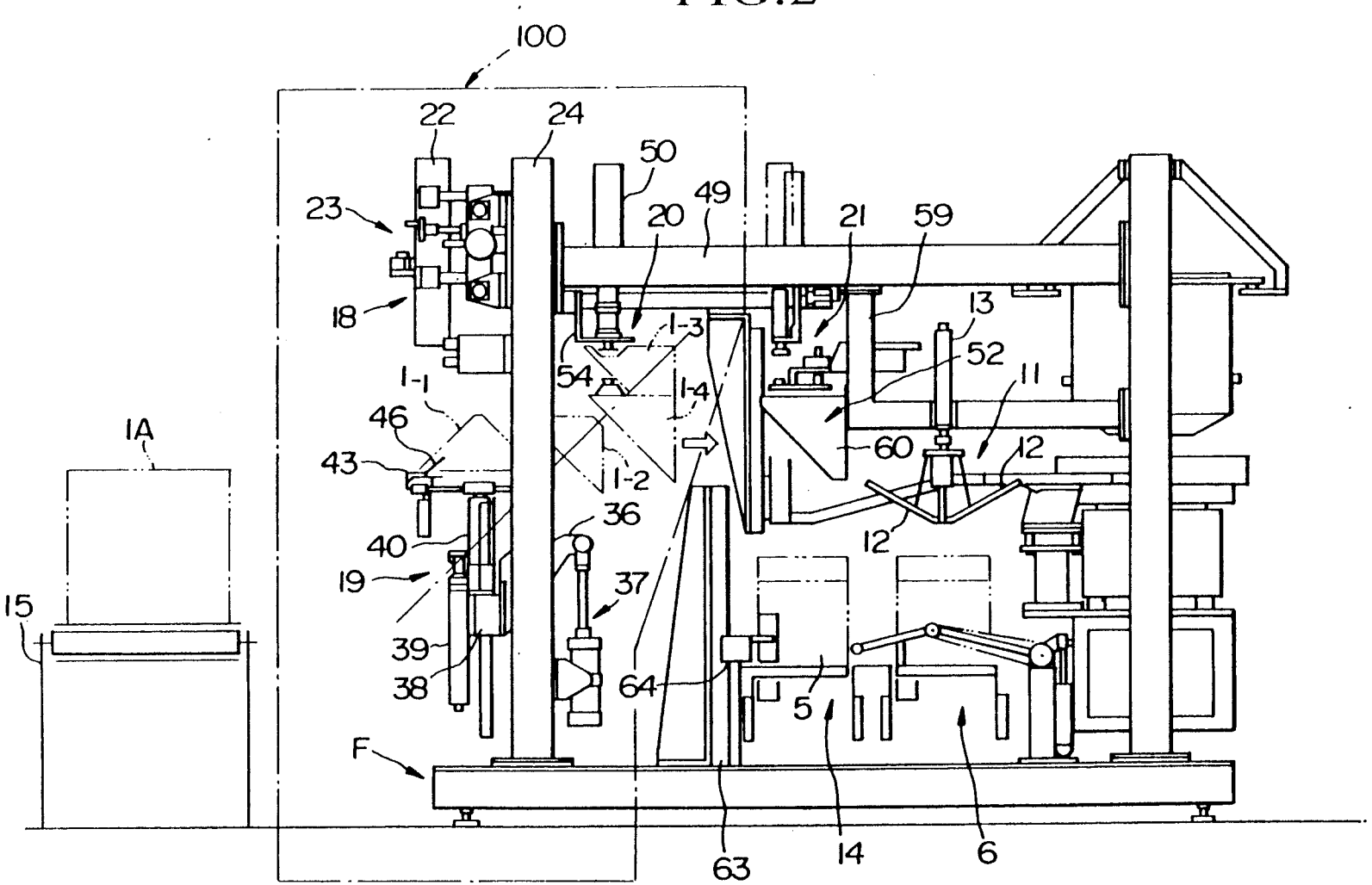
FIG. 2 is a side view as seen in the direction indicated by R in FIG. 1.

FIG. 1 shows an overall plan view of an automatic filling apparatus into which two transfer devices for transferring foldable container 1 have been incorporated. FIG. 2 shows a side view as seen in the direction of R as indicated in FIG. 1, with the section indicated by the numeral 100 representing the transfer device of the present embodiment.

In this filling apparatus, two each of the storage box 18, the container extraction mechanism 19 and the transfer mechanism which conveys the foldable containers are respectively provided on base frame F or on the support column which is erected thereon.

Further, the filling apparatus is provided with a filling part 21, for filling the containers 1 with a liquid material once the foldable containers 1 have been transported to the filling position A by the transfer mechanism 20, and with a conveyor line for transferring a corrugated storage box 5 or the like, used to hold the filled containers 1, to the filling position A.

Conveyor 15 is used for the stocking and transfer of the stacked configuration of foldable containers 1A. A raiseable stage (omitted from the figures), for transporting the stacked configuration 1A of containers 1 obtained from conveyor 15 to storage box 18, is provided in front of conveyor device 100. The stacked configuration of foldable containers 1A may also be manually transported to storage box 18; in this case, at least one of either the conveyor 15 or the raiseable stage may be omitted.

Figure 14:
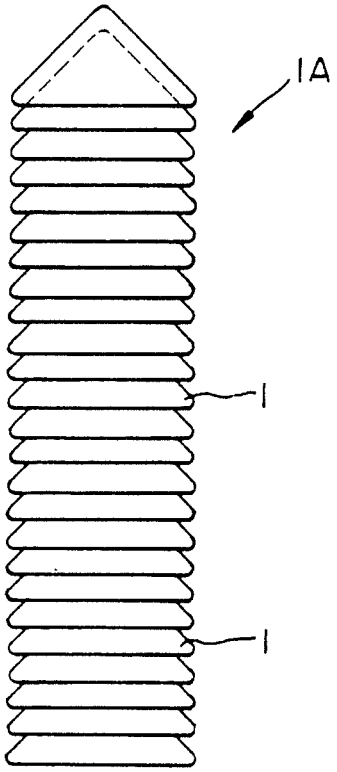
FIG. 14 is a side view of a stacked configuration of folded containers.

As is shown in FIG. 14, the stacked configuration 1A of containers 1 is formed by stacking on one another a plurality of foldable containers 1, the apex of each of which is directed upward; moreover, this stacking is carried out so that the positioning of each pour spout 3 of the foldable containers 1 alternates, this being done to prevent the stacked configuration 1A of containers 1 from tilting. However, if there is an absence of tilting in the stacked configuration of foldable containers, then it is not necessary to alternate the positioning of pour spout 3.

Figure 3:
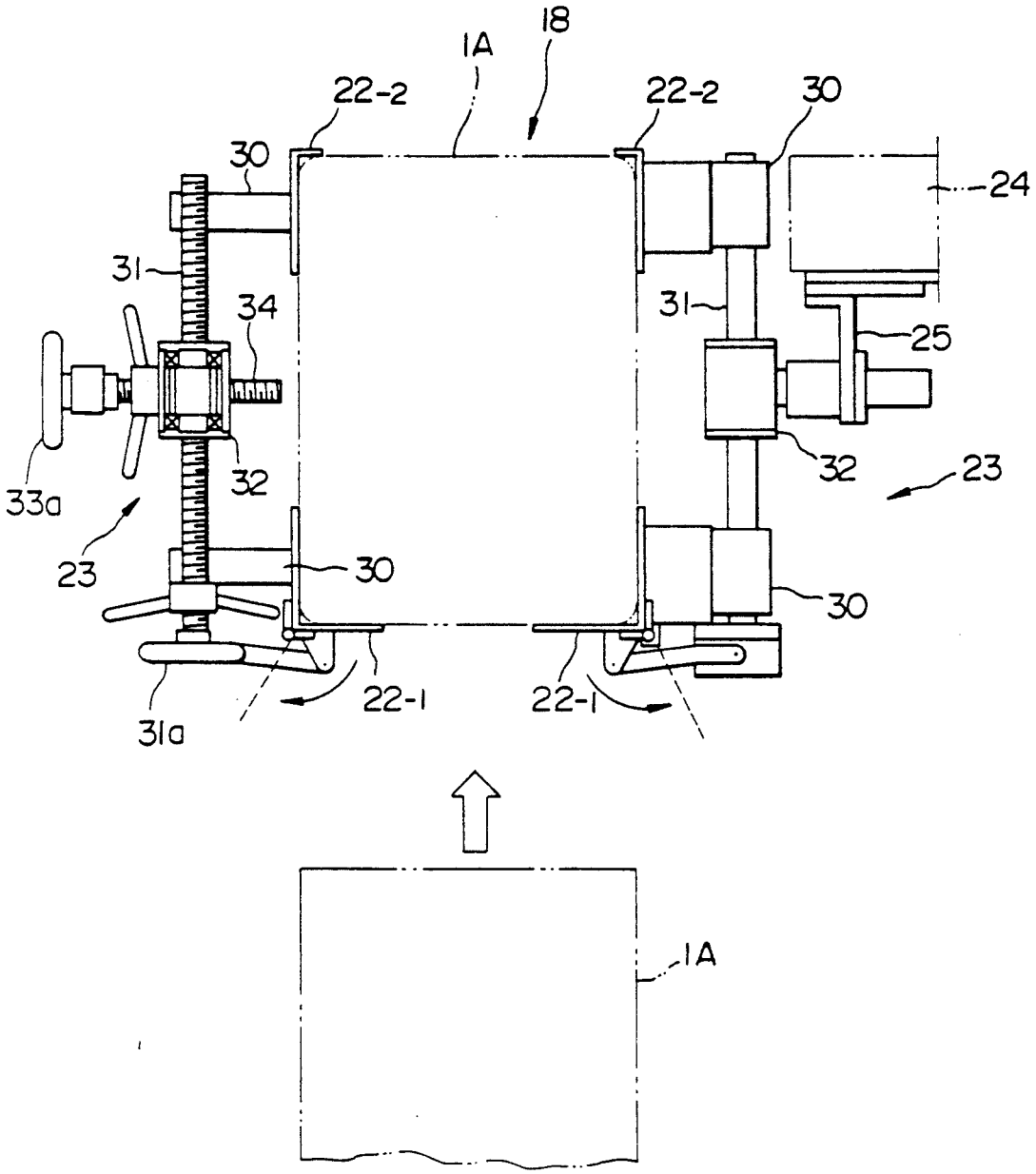
FIG. 3 is a plan view of a storage box.
Figure 4:
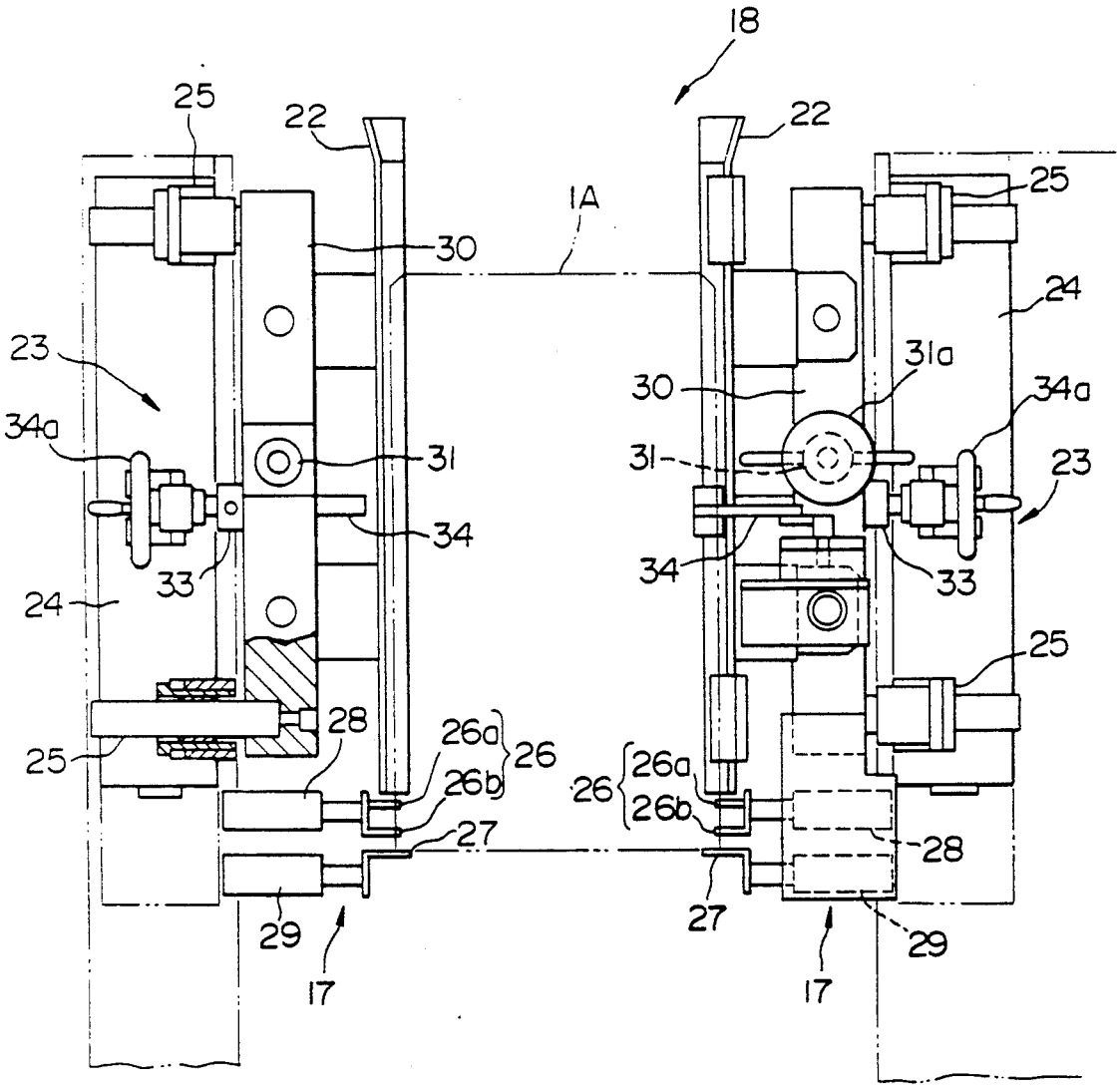
FIG. 4 is a side view of a storage box.

As is shown in FIGS. 3 and 4, storage box 18 is provided with four cross-sectional L-shaped frames 22 which are erected approximately vertically and so as to define a rectangular space between them. Further, storage box 18 is equipped with a dimensional adjustment mechanism 23 which is provided to both sides of frame 22 and with which the vertical and horizontal interval between frames 22, or in other words the cross sectional area defined by frames 22, can be adjusted. Moreover, shutter mechanisms 17 are provide below and to the side of frames 22. Once the vertical and horizontal interval between each of frames 22 has been set, additional adjustment is not necessary, and therefore dimensional adjustment mechanism 23 is not absolutely essential thereafter.

A stacked configuration 1A of containers 1 is inserted into storage box 18 in the progressing direction of the arrow indicated in FIG. 3. It is preferable to provide storage box 18 with a construction wherein a section of the frame 22-1, which is at the side of insertion, opens in the direction indicated by the arrow in the figure and, following the insertion of the stacked configuration 1A of containers 1 into storage box 18, closes. However, as it is possible to insert stacked configuration 1A of containers 1 through the top or bottom of storage box 18, it is in that case not essential to provide the opening and closing mechanism of frame 22-1.

Each frame 22 is supported by a post 24 via a stay 25. Each post 24 is provided with an upper support piece 26 and a lower support piece 27 which form shutter mechanism 17. Upper support piece 26 comprises a pair of upper and lower support pieces 26*a*, 26*b* disposed parallel to the horizon and provided at the tip of cylinder 28 which is supported by post 24 and is laterally moveable. Spacing sufficient to accommodate the external dimensions of the rectangular form of the container 1 is provided between each support piece 26*a* and 26*b*. Further, lower support piece 27, disposed in parallel to upper support piece 26, is provided at the tip of cylinder 29, which is supported by post 24, and is also laterally moveable. The spacing between the lower support piece 27 and the lower support piece 26*b* of the upper support 26 is approximately identical to the spacing between each of upper support pieces 26*a* and 26*b* of the upper support piece 26. It is not essential that a pair of one each of an upper and lower support piece 26*a* and 26*b* of the upper support piece 26 be provided; rather, a support piece 26*b* only may be provided. Moreover, a plurality of support pieces may be provided above support piece 26*a*.

Upper support piece 26 and lower support piece 27 are designed to be moveable from the outside to the inside of frame 22 by each cylinder 28 and 29. When the lower support piece 27 is moved within frame 22 by extending cylinder 29, the peripheral edge of the container 1 at the extreme bottom of the stacked configuration 1A of containers 1 rests upon support piece 27. In this manner, the stacked configuration 1A of containers 1 is contained within frame 22 without falling. Moreover, when cylinder 28 is then extended, the tips of each support piece 26*a*,26*b* clasp the peripheral edges of the second or third container from the bottom. The system is maintained in this state until the head part 43 of the container extraction device 19 is raised to the bottom end of the storage box.

The aforementioned container extraction mechanism 19 is provided below storage box 18.

Figure 5:
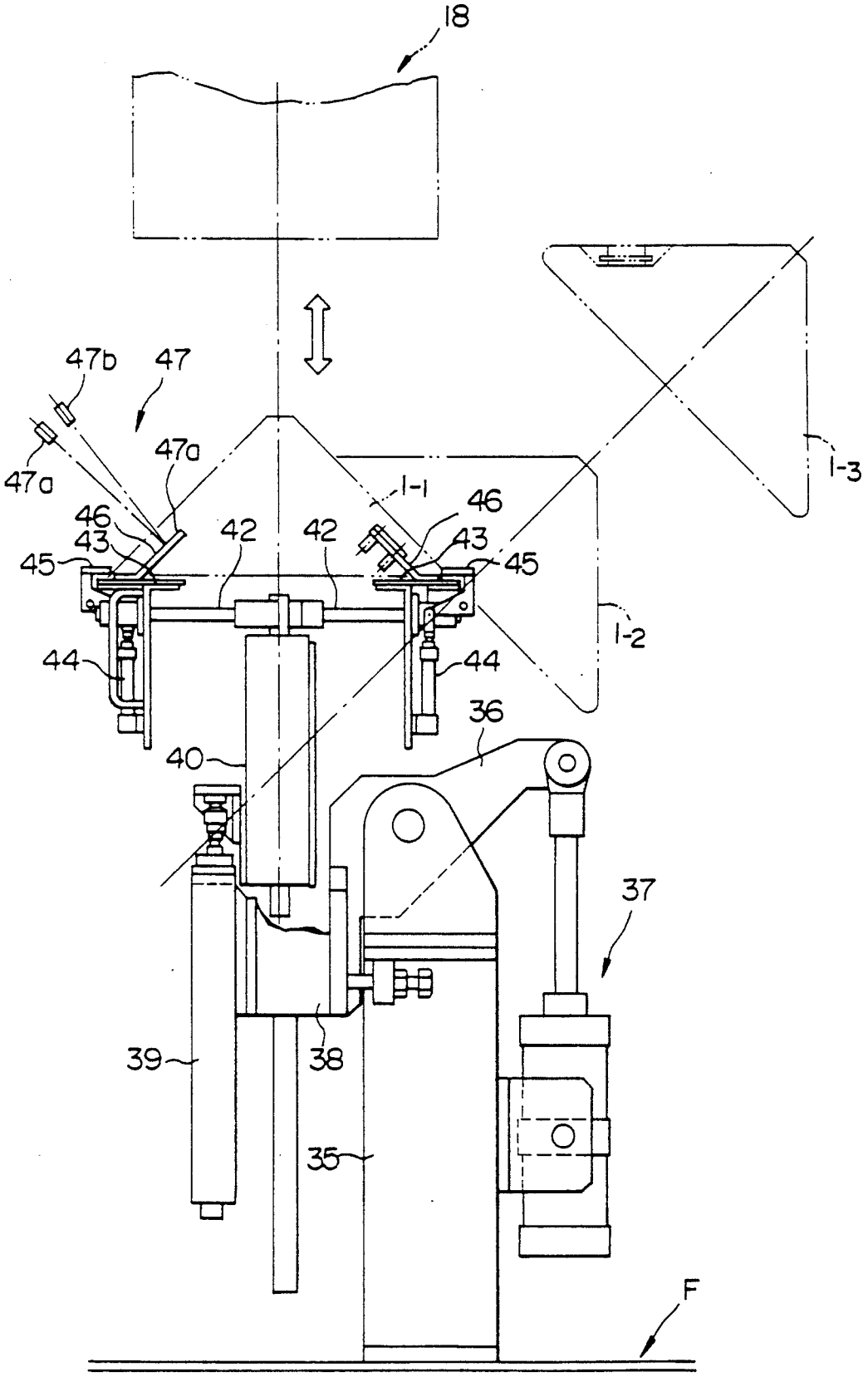
FIG. 5 is a side view of the container extraction mechanism.

As is shown in FIG. 5, container extraction mechanism 19 comprises: a stay 36, attached via a pin to the upper end of post 35 so as to oscillate along the vertical surface of post 35 which is erected on base frame F; an oscillating cylinder 37 which is attached at one end via a pin to post 35 and at the other end to stay 36, and which oscillates stay 36; a cylinder-shaped support body 38 which is fixed to the other end of stay 36; a vertically moveable rotary cylinder 40 provided to support body 38 via a vertically moveable cylinder 39; a pair of arms 42 disposed horizontally at the upper end of rotary cylinder 40; cross-sectional T-shaped head parts 43 fixed to the respective ends of arms 42; a clamper 45 provided to the end of head part 43 and oscillated at the peripheral inner surface of the container 1 by clamper cylinder 44; and pour spout sensors 47, which are equipped with reflecting plates 46, fixed on to and inclined approximately 45° with respect to head part 43, a light emitter 47*a* facing reflecting plates 46 and with a light receptor 47*b*, which receives a light signal from the light emitter 47*a*.

As the method of fixing head part 43, it is not essential that head part 43 be fixed to arms 42; a form of construction using other than arms 42 may also used. Moreover, the method wherein a pour spout sensor 47 as described above is used is not essential and some other method may be applied.

In container extraction mechanism 19, the standby state is one in which the oscillating cylinder 37 is the stroke end and clamper 45 is oscillated to the outer side by extending clamper cylinder 44. In this standby state, the axis of rotary cylinder 40 lies in the vertical direction and the upper surface of head part 43 is horizontal. In the standby state, rotary cylinder 40 and head part 43 are raised together to the lower end of storage box 18 by the vertically movable cylinder 39. The lower peripheral edge of the extreme bottom container in the stacked configuration 1A of containers 1 within storage box 18 rests on top of head part 43. In this configuration, when clamper cylinder 44 contracts, the peripheral edge of container 1 is pressed against head part 43 by clamper 45. Following this, the lower support piece 27 of storage box 18 is retracted, head part 43, with only the extreme bottom container being clamped by clamper 45, is lowered, and the operation for extracting a single container is completed.

Each pour spout sensor 47 detects the presence or absence of a pour spout 3. Rotary cylinder 40 operates based on the detection signals from pour spout sensors 47. By means of rotary cylinder 40, head part 43 rotates the container 1 so that the surface which is not provided with a pour spout 3 is turned so as to face opposite the side of the filling station. In other words, for a single container 1 which has been extracted from storage box 18 and rested on head part 43, if the pour spout 3 is located at a surface of container 1 which is on the side of the filling station, rotary cylinder 40 rotates 180°. If, however, pour spout 3 is located on the side of storage position A as shown in FIG. 1, then the container 1 is not moved. In the case of the present embodiment, because container 1 is stacked so that the pour spouts 3 of successive containers 1 alternate with one another, head parts 43 are rotated one at a time by means of rotary cylinder 40.

However, when a stacked configuration 1A of containers 1 is stored in storage box 18 in such a way that the pour spouts 3 are ordinarily located at a surface of container 1 which is not on the side of the filling station, then rotary cylinder 40 and pour spout sensor 47 are not necessary.

With pour spout 3 located on the side of container 1 opposite that which is on the side of the filling station, when oscillating cylinder 37 contracts by a preset stroke, the orientation of container 1—1 on head part 43, is altered so that the surface of container 1—1 at which pour spout is formed is moved into a horizontal position. Accompany this is an inclining by 45° of support base 38, which is supported by stay 36, toward the side of the filling station. In other words the orientation shown by 1-2 in FIGS. 2 and 5 results. Following this, the container 1 on head part 43 is transported upward at a 45° angle by vertically movable cylinder 39. In other words, the orientation shown by 1-3 in FIGS. 2 and 5 results.

Transfer mechanism 20 is provided at the rear surface of storage box 18. As is shown in FIG. 6, transfer mechanism 20 is provided with a horizontal cylinder 48, a vertically moving cylinder 50, which lies along frame 49 and moves from above container extraction mechanism 19 to filling position A, and a chuck 51 which is moved vertically by vertically moving cylinder 50 and which clamps onto the thread ring 4 of pour spout 3.

A plurality of claws 51*a*, which are provided to chuck 51, open and close by means of chuck cylinder 53 and, when closed, overlap the lower surface of screw thread 4*b* which is formed at the extreme bottom of thread ring 4 of pour spout 3.

Figure 6:
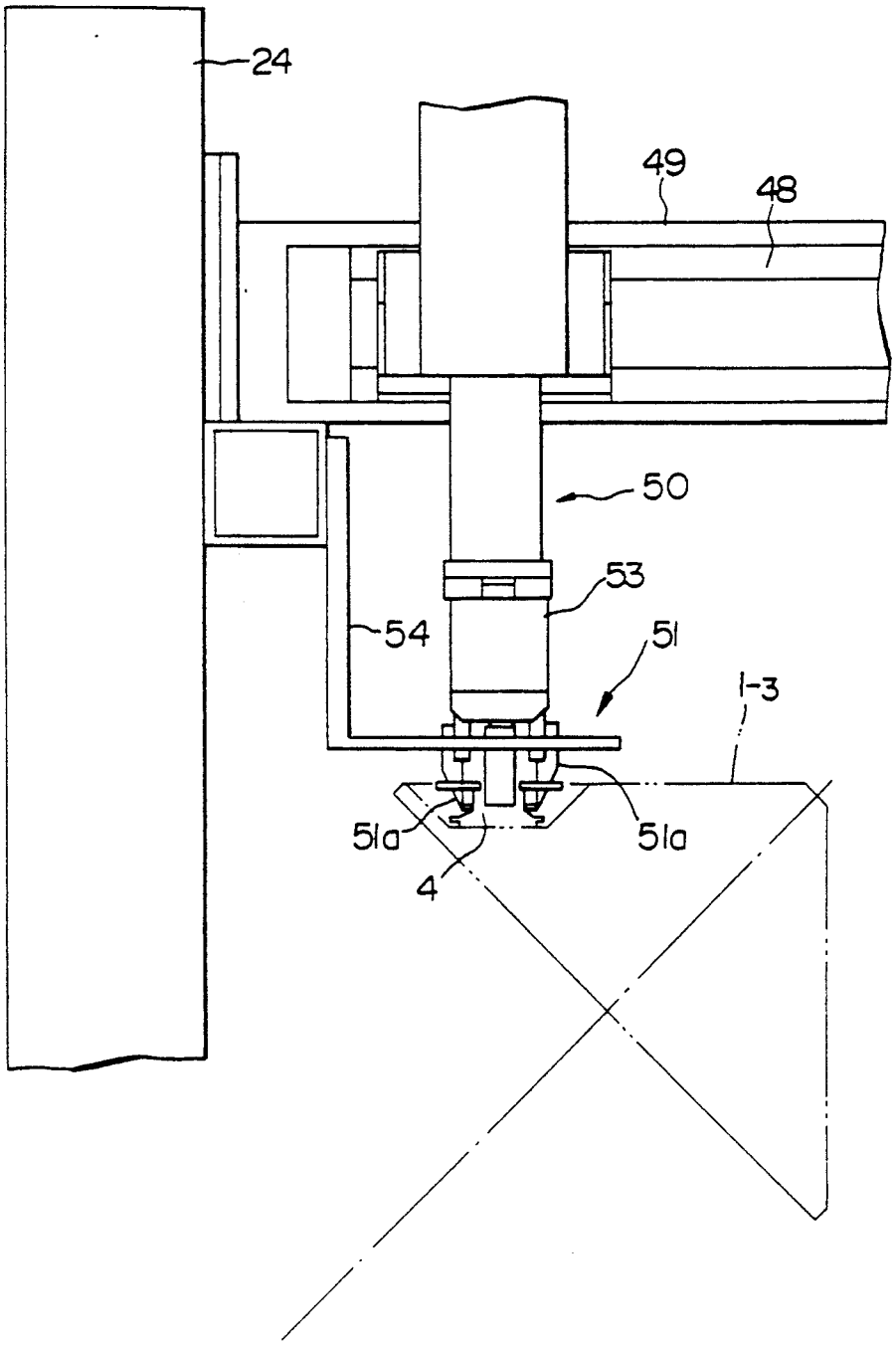
FIG. 6 is a side view of the transfer mechanism.
Figure 7:
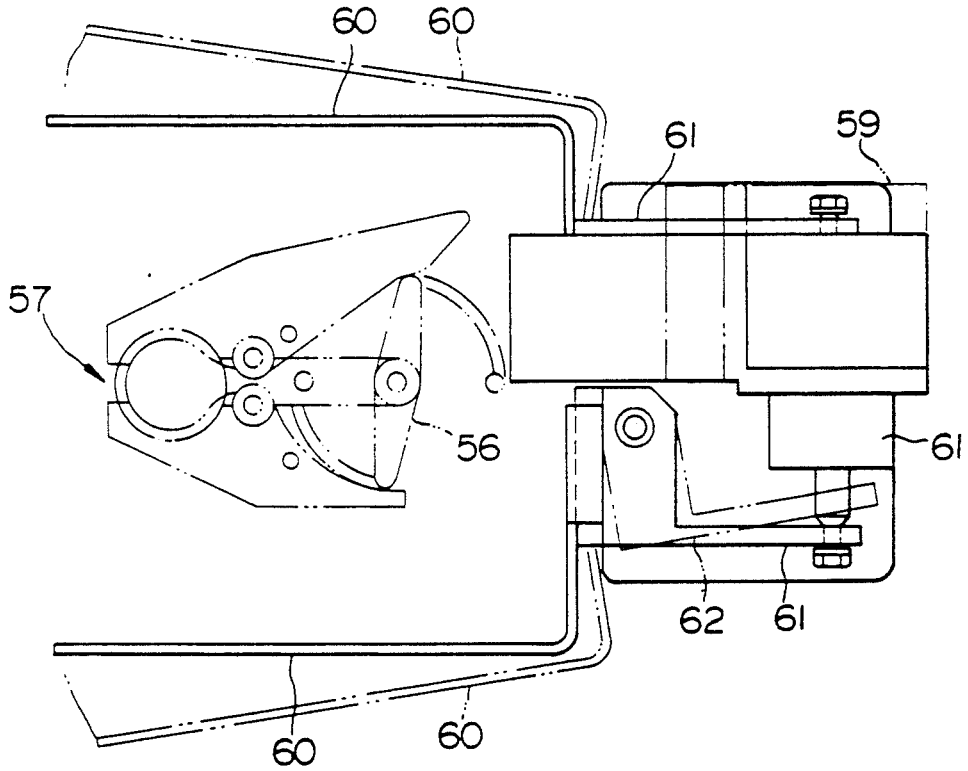
FIG. 7 is a plan view of the container holder.
Figure 8:
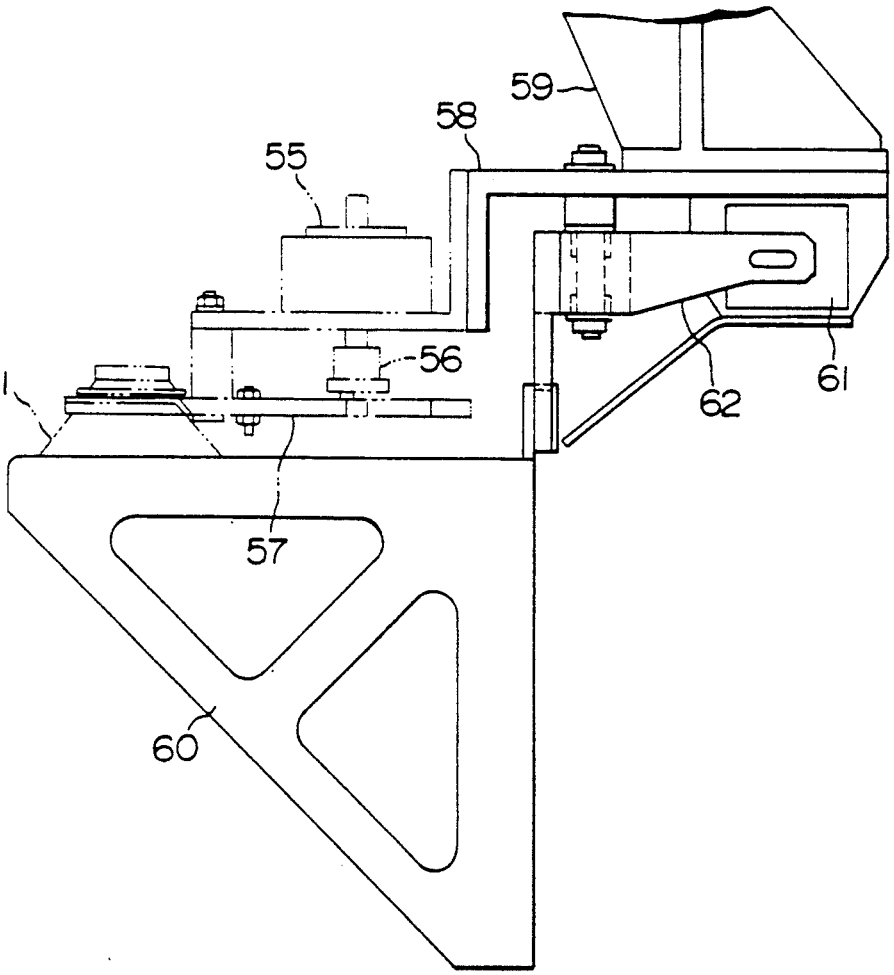
FIG. 8 is a side view of the container holder.
Figure 9:
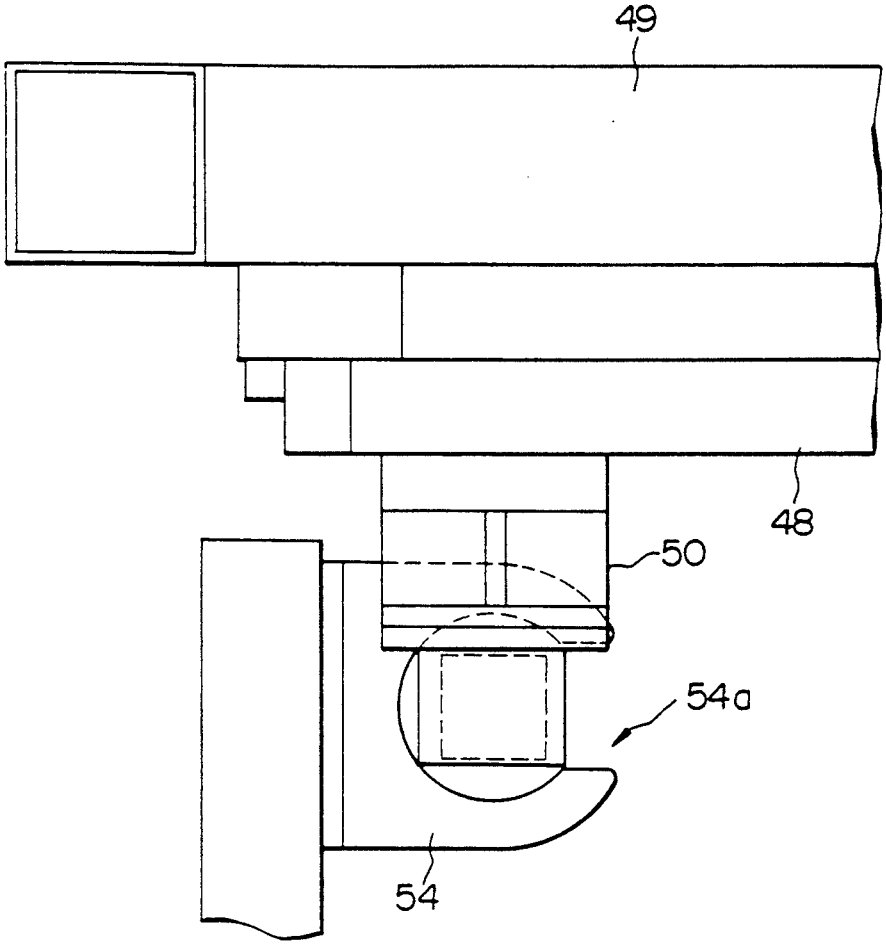
FIG. 9 is a plan view of the transfer mechanism.

Moreover, as is shown in FIGS. 6 and 9, container holding piece 54 is provided in between container 1-3, the orientation of which has been altered by container extraction mechanism 19, and chuck 51, which has been positioned by horizontal cylinder 48 at the lowest inlet side (side of storage box 18). Container holding piece 54, having notches 54*a* formed in the ring shaped plate material of the side of filling position A, is disposed horizontally, and is fixed to post 24. Because the internal peripheral diameter of container holding piece 54 is larger than those of the external diameter of flange 4*a* of thread ring 4 and chuck 51, flange 4*a* and chuck 51 can pass within container holding piece 54. Furthermore, the width of notches 54*a* are larger that the external diameter of chuck 51.

Figure 10:
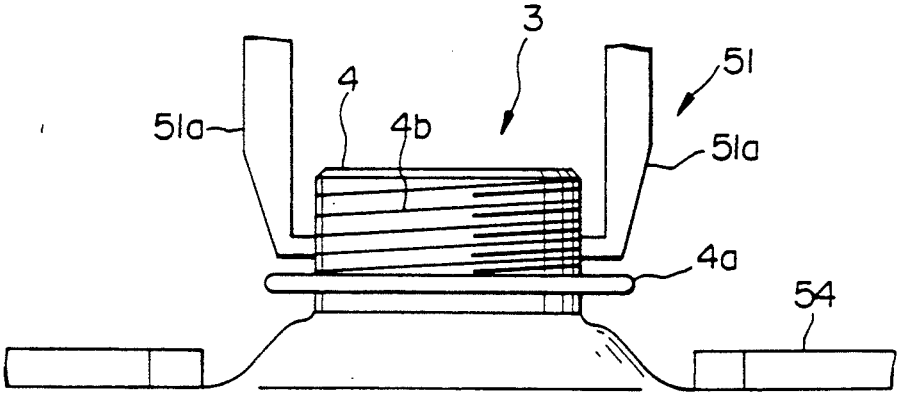
FIG. 10 is a side view showing the lifting of the thread ring by the chuck.
Figure 11:
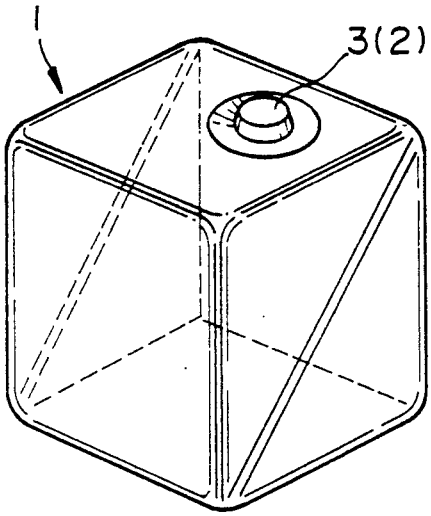
FIG. 11 is a three dimension perspective view of a container.
Figure 12:
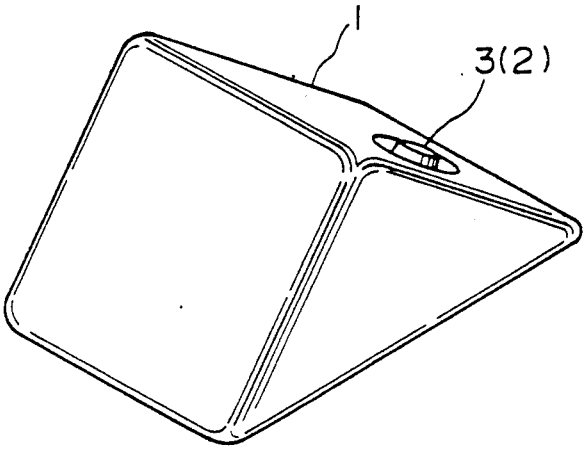
FIG. 12 is a three dimension perspective view of a folded container.
Figure 13:
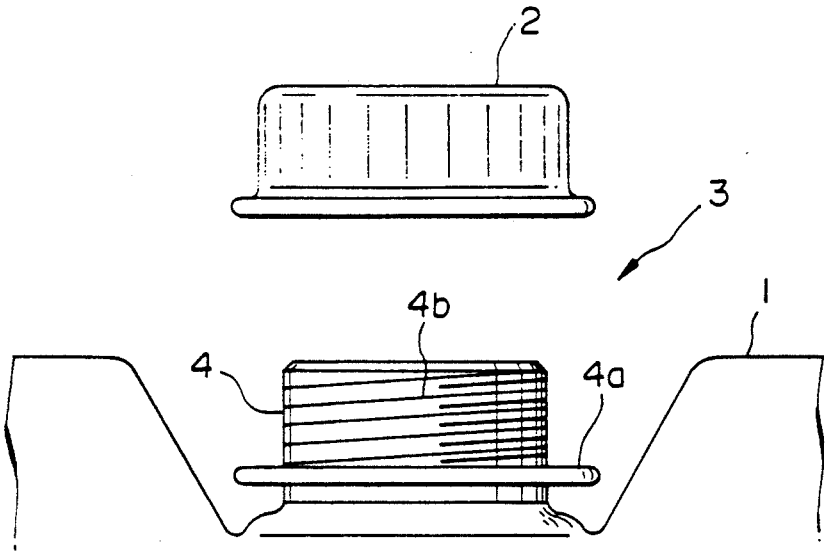
FIG. 13 is a side view of the pour spout.

In transfer mechanism 20, chuck 51 is positioned by horizontal cylinder 48 in the standby position above container extraction mechanism 19. Chuck 51, which is open, is turned toward container 1-3, which has been oriented by the container extraction mechanism 19. Chuck 51 is dropped to the area of thread ring 4 by vertically moving cylinder 50, passing through container holding piece 54. Then, chuck 51 is closed by chuck cylinder 53, and thread ring 4 is clamped by chuck 51. Next, chuck 51 is raised by vertically moving cylinder 50 until the upper surface of container 1 at which pour spout 3 is formed is pushed by container holding piece 54. Further, due to the raising of chuck 51 to this extent, depressed thread ring 4 is lifted and made to project outward, as is shown in FIG. 10.

Chuck 51, by which container 1 is clasped, is lowered to a preset position by vertically movable cylinder 50 (the state of container 1-4 in FIG. 2). Container 1 which is clamped by chuck 51 is transported by horizontal cylinder 48 to the filling position A for the next processing step.

Additionally, a construction such that the operation of extracting pour spout 3 from its retracted position within container 1 and projecting it outward is carried out at the position indicated in FIG. 2 is not absolutely essential, and rather a construction may be provided wherein this operation is carried out at some other position in the filling apparatus. For example, it is permissible to carry out the above operation by any number of steps either during or after transfer of container 1, which is clasped by transfer mechanism 20, to the next processing step. Accordingly, it is not absolutely essential to include container holding piece 54 in transfer mechanism 20. Further, once chuck 51 has clasped container 1, the transfer direction is not limited to the direction of horizontal cylinder 48 as is shown in FIG.

6, but may also be horizontal, vertical or diagonal. Additionally, the transfer path does not necessarily have to be straight but may also be curved.

Container holder 52 is provided opposite container holding piece 54, and is provided with arm 56 which is oscillated by rotary actuator 55 in the horizontal plane, and with a pincher shaped holder 57 which opens and shuts by means of the oscillation of arm 56. These are attached to frame 59 via stay 58. Holder 57 is constructed so that flange 4a of thread ring 4 of pour spout 3 can be supported from the bottom.

Furthermore, a pair of holder plates 60 are provided so as to surround holder 57 are provided to stay 58. Holder plates 60 are attached to bracket 62 which is oscillated in the horizontal plane by cylinder 61. When cylinder 61 contracts, its pair of holder plates 60 widen outward. The other pair of holder plates widen in the same manner, and the surface area of the opening of both holders 60 enlarges. In storing container 1, holder plates 60 act as the guide, running along the inner surface of and into storage box 5. Holder plate 60 may be interchanged as appropriate in response to the measurements of storage box 5.

Container 1, which is clamped by chuck 51, is transferred to container holder 52 by horizontal cylinder 48. When container 1 is transferred with holder piece 57 of container holder 52 and both holder plates 60 open, holder piece 57 is inserted in the lower side of flange 4a of thread ring 4 of pour spout 3, and the container 1 is stored between both plates 60. When, from this orientation, holder piece 57 is closed by rotary actuator 55 and provided that chuck 51 is opened and lifted, container 1 is stored in container holder 52.

Provided in the filling apparatus of the present embodiment is a storage box lifting mechanism 64 wherein container 1, which is supported by container holder 52, is stored within storage box 5 by means of the clasping and holding of the storage box 5, which is transported on the conveyor 14, and by the lifting of storage box 5 by cylinder 63 which is erected on and supported by base frame F.

In contrast, according to the automated filling apparatus of the present embodiment, the storage boxes 5 are transferred by conveyor 6. During transportation, once the lid has been completely opened by the lid opening mechanism 11, the storage boxes 5 are stopped alternately by the primary and secondary stoppers 9 and 10. The storage box 5 stopped by primary stopper 9 is transferred to sending conveyor 14 by primary pusher 7. In the same manner, the storage box 5 stopped by secondary stopper 10 is transferred to sending conveyor 14 by secondary pusher 8.

Container 1 is held by container holder 52, storage box 5 is raised by storage box lifting mechanism 64, and container 1 and holder plate 60 are received within storage box 5. Following this, as is shown by filling station 21, container 1 is filled with liquid, and the cap 2 is screwed on. Further, if the support provided by container holder 52 is released by opening holder piece 57, and the storage box 5 is lowered by storage box lifting apparatus 64, container 1 will be received within storage box 5.

Then, the container 1 which has been received within storage box 5 is transported to a predetermined position for deposit by sending conveyor 14.

In the foldable container transportation device for use with storage boxes according to the present embodiment, the operation wherein containers are extracted one at a time from a stacked configuration of a plurality of containers 1A, and are conveyed to the filling position A is completely automated, requiring no reliance on manual labor. Therefore, the entire operation of filling container 1 with liquid can be completely automated. Moreover, due to this automation, the present invention is particularly suitable for application in the case where filling container 1 with a liquid for consumption wherein strict sanitary control must be exercised.

Further, in the case where container 1 is flexible, possessing very little rigidity and therefore making handling difficult, the operation wherein the containers 1 are extracted one at a time from the stacked configuration 1A of containers 1, are oriented by storage container extraction mechanism 19 so that the surface at which pour spout 3 is provided is approximately horizontal and, following this, are received within storage box 5, may be carried out with ease and accuracy.

Still further, because in the embodiment of the present invention, there are two filling positions, and two each of storage box 18, container extraction mechanism 19 and transfer mechanism 20 respectively are provided, it is possible to receive within two storage boxes 5 two containers simultaneously. It is therefore possible to incorporate an improvement in the processing ability.

What is claimed is:

1. A transfer device for transferring a foldable container wherein said container is one which is formed from a thin flexible film material, has an approximately cubical shape when unfolded and is provided with a pour spout at one surface, wherein a plurality of said containers are folded into an approximately triangular shape by inverting one-half of said container within the other half of said container by folding along the diagonal plane which extends between a pair of diagonally opposing edges and passes through the center of said container, each folded container having an apex and an approximately rectangular bottom surface, wherein said containers are stacked to form a stacked configuration, having a top and a bottom, of said containers, wherein said transfer device comprises:

a storage box which stores foldable containers including a pour spout, in a stacked configuration such that the apex of said foldable container is directed upward and the approximately rectangular bottom surface of said container is approximately horizontal and is supported by said storage box, wherein at least the bottom of said storage box is open and said storage box is provided with a shutter mechanism from which the container located at the bottom of the stack may be extracted;

a container extraction mechanism disposed below said storage box and provided with a head part for sequentially extracting containers from the bottom of said stack of containers and subsequently inclining said container so that said pour spout is directed upward and, maintaining said container in this position, said head part is transported in the direction of said inclination of said container; and a transfer mechanism, disposed above said container extraction mechanism, said transfer mechanism having a chuck for grasping said pour spout on said container and transferring said container to a next processing step.

2. The transfer device according to claim 1, wherein said storage box comprises:

a frame having four L-shaped members, wherein said members are erected vertically so as to define a rectangular shape therebetween;

an adjustment mechanism provided on two opposite sides of said frame which adjusts the horizontal distance between said four members; and a shutter mechanism disposed below and to the sides of said frame.

3. The transfer device according to claim 1, wherein said storage box, said container extraction mechanism and said transfer mechanism are provided on a base frame and wherein said container extraction mechanism comprises a post, having an upper portion and a lower portion, erected on said base frame, a stay connected via a pin to the upper portion of said post and so as to be movable vertically, a first rotatable cylinder for rotating said stay and attached via a pin to one end of said stay, a cylindrically shaped support body affixed to the other end of said stay, a second rotatable cylinder provided to said support body and vertically movable via a vertically movable cylinder, a pair of arms disposed horizontally to one end of said second rotatable cylinder, cross-sectional T-shaped head parts affixed to the respective tips of said arms, a clamper provided to the tips of said head parts and movable in the vertical plane by a clamper cylinder, and a pour spout sensor.

4. The transfer device according to claim 3, wherein said transfer mechanism is equipped with a horizontal cylinder, a vertical cylinder which moves along a frame from above said container extraction mechanism to said next processing step and said chuck which is moved vertically by said vertical cylinder and clamps onto said pour spout of said container.

* * * * *